United States Patent [19]

Ward

[11] 4,409,296

[45] Oct. 11, 1983

[54] RAPIDLY CAST ALLOY STRIP HAVING DISSIMILAR PORTIONS

[75] Inventor: Brian L. Ward, Woking, England

[73] Assignee: Allegheny Ludlum Steel Corporation, Pittsburgh, Pa.

[21] Appl. No.: 199,149

[22] Filed: Oct. 22, 1980

[30] Foreign Application Priority Data

May 9, 1979 [GB] United Kingdom ..... 7916035

[51] Int. Cl.[3] ..... B32B 15/00

[52] U.S. Cl. ..... 428/610; 428/678; 428/681; 428/685; 428/925

[58] Field of Search ..... 428/678–685, 428/610, 925

[56] References Cited

U.S. PATENT DOCUMENTS

| | | | |
|---|---|---|---|
| Re. 29,989 | 6/1979 | Polk et al. | 428/661 |
| 905,758 | 12/1908 | Strange et al. | 164/87 |
| 993,904 | 5/1911 | Strange | 164/429 |
| 3,856,513 | 12/1974 | Chen et al. | 75/122 |
| 3,871,836 | 3/1975 | Polk et al. | 75/122 |
| 3,904,378 | 9/1975 | Higbee et al. | 428/685 |
| 4,142,571 | 3/1979 | Narasimhan | 164/88 |
| 4,232,096 | 11/1980 | Franzen et al. | 428/683 |
| 4,250,229 | 2/1981 | Kear et al. | 428/606 |

OTHER PUBLICATIONS

Merriman, A. D., *A Dictionary of Metallurgy,* MacDonald & Evans, Ltd., p. 338.

Geiger, G. H., et al; *Transport Phenomena In Metallurgy,* pp. 431–449, 455–463 (1973).

E. H. Sargent & Co., *Table of Periodic Properties of the Elements,* p. Side 2 (1964).

Maissel, Leon I., et al, *Handbook of Thin Film Technology,* pp. 4–10, 4–11, (1970).

Chen, H. S., et al; "Centrifugal Spinning of Metallic Filaments", *Mat. Res. Bull.* vol. 11, pp. 49–54 (1976).

Weast, R. C., et al; *CRC Handbook of Chemistry and Physics,* 60th edition, p. D–187 (1979).

*Metallic Glasses,* Am. Soc. for Metals, pp. 75, 76, 248 to 250, (1976).

Lieberman, H. H., Manufacture of Amorphous Alloy Ribbon, Transactions on Magnetics, vol. MAG–15, pp. 1393–1397, No. 6, (Nov., 1979).

*Primary Examiner*—Michael L. Lewis

*Attorney, Agent, or Firm*—Patrick J. Viccaro

[57] ABSTRACT

A rapidly quenced, cast metallic strip is disclosed comprising a plurality of dissimilar portions, each portion metallurgically alloy-bonded during casting to adjacent portions along the longitudinal extent of the strip. In the method and apparatus for producing such strip a stream of molten metal is delivered onto a casting surface from a first crucible and at least one additional dissimilar stream of molten metal is delivered onto the casting surface such that a peripheral edge of the dissimilar stream contacts a peripheral edge portion of adjacent dissimilar metal to create a metallurgical alloy-bond therebetween during casting.

21 Claims, 10 Drawing Figures

RAPIDLY CAST ALLOY STRIP HAVING DISSIMILAR PORTIONS

BRIEF SUMMARY OF THE INVENTION

The present invention relates to a new and improved metallic strip material, and more particularly to a rapidly cast metal strip having dissimilar longitudinal portions metallurgically alloy-bonded to one another during casting of the strip. This invention also pertains to a method and apparatus for producing such strip.

This invention is directed to strip materials, whether amorphous, crystalline or combinations thereof, having dissimilar portions. In a preferred embodiment this invention relates to metal alloys in strip form, at least a portion of which are amorphous. In this specification the term "amorphous" is intended to refer to composition in which at least 50% is amorphous, which is typically measured by X-ray defraction.

Since the early 1900's it has been taught, such as in U.S. Pat. Nos. 905,758 and 993,904, that metallic strip material could be continuously produced by delivering molten metal to a moving chill surface. More recent developments, such as U.S. Pat. No. 4,142,571 teach specific refinements in strip casting nozzle structure to aid in the production of strip material. Also, various references, including U.S. Pat. No. 3,856,513, disclose preferable alloys, particularly for the production of amorphous strip and wire material.

For certain applications, it has been found beneficial to join at least two sheets of strip material along their longitudinal axis. Such joining can be used to obtain a strip having a greater overall width, or can be used to join dissimilar portions. Common techniques for joining a plurality of strips include welding, brazing and soldering. However, certain factors, including the heat, and particularly the heat gradient, generated in welding, brazing and soldering can adversely affect the quality of such composition or the quality of the multiplex strip material.

As mentioned above, a preferred embodiment of the present invention pertains to strip material in which at least one dissimilar portion is amorphous. Amorphous metal alloys are those produced by a process in which crystallization is avoided, typically by extremely rapidly quenching the metal from the liquid state. Such cooling rate is usually on the order of at least about 104° C. per second. Because of their atomic arrangement and composition, some amorphous alloys can possess enhanced properties, including higher strength and increased resistance to chemical attack when compared to conventional crystalline alloys. Therefore, such amorphous alloys may be ideally suited for uses including but not limited to razor blade edge materials due to their properties of strength, hardness, ductility and corrosion resistance. Certain amorphous materials are also known to possess enhanced magnetic and electrical properties and the strip of the present invention may be desirable for electrical end uses.

The present invention applies equally to rapidly cast crystalline materials which have a multitude of uses. The present invention further comprehends combinations of dissimilar crystalline materials, dissimilar amorphous materials and combinations thereof where it is desirable to utilize such dissimilar materials to decrease the overall cost of the composite, or multiplex strip, or to localize desired properties, gage, etc. of dissimilar materials in a composite strip. For example, the present invention may be utilized to produce delicate material by simultaneously providing edge portions of a more rugged material which would facilitate the handling of the delicate material. After production, the handling portions could easily be trimmed from the strip. Also, this invention could be utilized to join alloys which exhibit different thermal electric properties, suitable for use in the production of thermocouples or multiple thermocouples. Additionally, the present invention may be employed to case strip having varying gages across the width thereof to intentionally vary the mechanical strength, electrical properties, etc. across the width of the strip. Further, this invention can be used to produce strip having alloys of various expansion characteristics across the width thereof. Thus, by heating such strip an intentional curvilinear strip configuration may be obtained. It should be understood that a variety of applications can be made of the strip of this invention, and that the above examples are merely illustrative and should not be interpreted as limiting the scope of this invention in any manner.

Accordingly, a new and improved multiplex strip material is desired in which dissimilar portions are joined in a fashion which does not adversely affect either the overall quality of such individual strip components or the integrity of each of such strips. Likewise, a new and improved method and apparatus for producing such strip components and multiplex combinations is desired.

The present invention may be summarized as providing a new and improved rapidly, quenched cast metallic strip comprising a plurality of dissimilar portions cast edge-to-edge, each portion metallurgically alloy-bonded during casting to adjacent portions along the longitudinal extent of the strip. In the method and apparatus for producing such strip a stream of molten metal is delivered onto a casting surface from a first crucible and at least one additional dissimilar stream of molten metal is delivered onto the casting surface such that a peripheral edge of the dissimilar stream contacts a peripheral edge portion of adjacent dissimilar metal to create a metallurgical alloy-bond therebetween during casting.

Among the advantages of the present invention is the ability to combine a plurality of dissimilar portions into a composite strip material with a metallurgical alloy-bond between adjacent dissimilar portions which is created during the casting of such strip material without adversely affecting the quality or properties of the individual strip portions.

An objective of the present invention is to provide a strip of rapidly cast material having at least two dissimilar portions metallurgically alloy-bonded along the length of the strip thereby forming a multiplex strip, or composite strip, exhibiting different properties, structure or quality in each portion of the strip.

Another advantage of the present invention is the provision of a method and an apparatus for rapidly casting a strip comprised of dissimilar portions metallurgically alloy-bonded to one another along the length of the strip during the casting operations without adversely affecting the quality or the properties of the strip material.

It follows that a further advantage of the present invention is that where strength, corrosion resistance and other qualities are required only at an edge or at the edges of the strip material, the expensive alloying ingredients, such as cobalt and molybdenum only have to be used at such edge portions of a multiplex strip material, thus reducing the cost of the strip.

Another objective of this invention is to provide a strip of metallurgically alloy-bonded amorphous and crystalline portions without causing the amorphous portion to crystallize during the bonding thereof. Another objective is to provide a strip of components joined at a transition zone wherein an alloy formed at the transition zone has enhanced properties over those of the joined portions.

These and other objectives and advantages will be more fully understood and appreciated with reference to the following detailed description and to the accompanying drawings.

DETAILED DESCRIPTION

Figure 1:
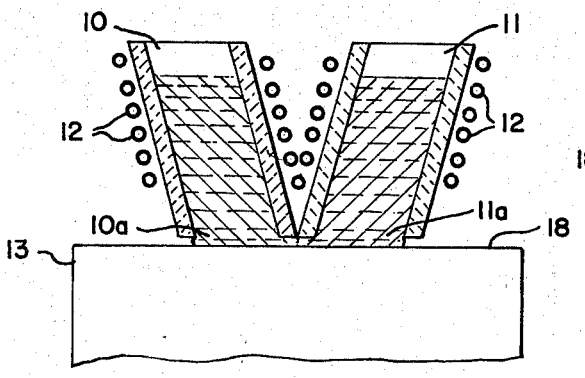
FIG. 1 is a front cross-sectional view of an apparatus of the present invention.
Figure 2:
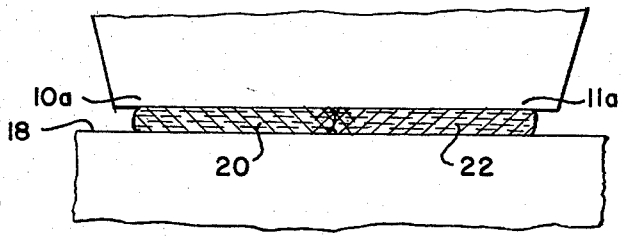
FIG. 2 is an enlarged cross-sectional view of the nozzle area of the apparatus shown in FIG. 1.
Figure 6:
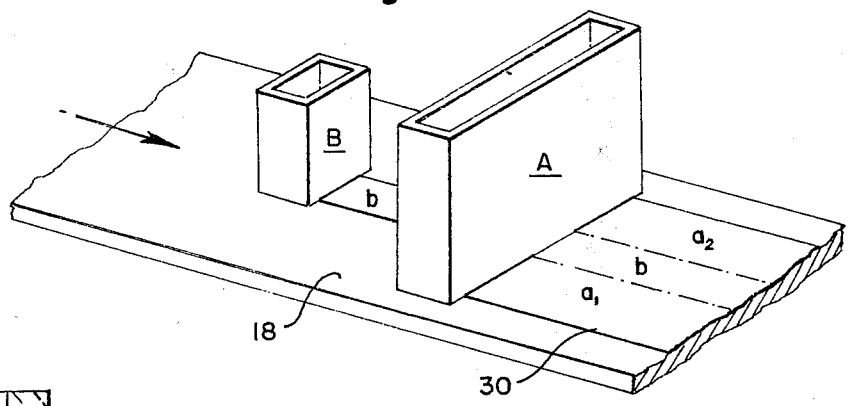
FIG. 6 is a perspective view of an alternative apparatus of the present invention.

Referring particularly to the drawings, FIGS. 1 and 2 illustrate a preferred apparatus of the present invention. As shown in FIG. 1 this apparatus includes a first crucible 10 having an internal cavity designed to receive and hold molten metal. The first crucible 10 also includes a nozzle 10*a* through which a first stream of molten metal is delivered from the cavity to a casting surface 18. In a preferred embodiment the continuous strip material 30 is cast on a relatively smooth, outer peripheral surface 18 of a circular drum or wheel 13. It should be appreciated that configurations other than circular may be employed, for example, the strip of the present invention could be cast onto a moving belt as shown in FIG. 6, onto the interior surface of a drum, between a pair of facing rollers, into a quench fluid, or the like.

In a preferred embodiment, the casting element 13 comprises a water cooled, precipitation hardened copper alloy wheel containing about 90% copper. Copper and copper alloys are chosen for their high thermal conductivity and wear resistance, however, steel, brass, aluminum, aluminum alloys or other materials may be utilized alone, or multipiece wheels having sleeves of molybdenum or other material may also be employed. Likewise, cooling may be accomplished with the use of a medium other than water. Water is chosen for its low cost and its ready availability.

In the operation of the strip casting apparatus of the present invention, the outer peripheral surface 18 of the casting wheel 13 must be able to absorb the heat generated by contact with molten metal at the initial casting point, and such heat must diffuse substantially into the copper wheel during each rotation of the wheel. Removal of the diffused heat may be accomplished, for example, by delivering a sufficient quantity of water through internal passageways located near the periphery of the casting wheel 13. Alternatively, the cooling medium may be delivered to the underside of the casting surface. Understandably, refrigeration techniques and the like may be employed to adjust and optimize cooling rates, for example, to effectuate wheel expansion or contraction during strip casting.

Whether a drum, wheel or belt is employed for casting, the casting surface 18 should generally be smooth and symmetrical to maximize uniformity in strip casting. For example, in certain strip casting operations wherein it is desired to case uniform gage strip, the distance between the outer peripheral casting surface 18 and the surfaces defining the orifice or the nozzle 10*a* or 11*a* which is feeding the molten material onto the casting surface 18 should not substantially deviate from a desired or set distance. This distance shall hereinafter be called standoff distance or gap. It is understandable that the gap at each nozzle should normally be substantially maintained constant throughout the casting operation when it is the intention of the operator to cast uniform, gage strip portions from that nozzle. If, however, controlled variations of thickness are desired either in the complete composite or in certain component strips of the composite, then a programmed standoff distance both for the whole nozzle component array and/or for each contributing nozzle may be employed.

It should also be understood that if the casting element is a drum or a wheel, the element should be carefully constructed so as not to be out-of-round during operation to insure uniformity in strip casting. Along these lines, it has been found that a drum or wheel which is out-of-round by about 0.020 inch, or more, may have a magnitude of dimensional instability which, unless corrected or compensated during operation, may be unacceptable for certain strip casting operations. It has been found that acceptable dimensional symmetry may be accomplished by fabricating a wheel or drum from a single, integral slab of cold rolled or forged copper. However, as mentioned above alternative meterials may be employed.

The molten materials to be cast in the apparatus described herein is preferably retained in a crucible or tundish, which is provided with a corresponding nozzle. The nozzle is typically, though not necessarily, located at a lower portion of the crucible as shown in the drawings. The nozzle may be an integral part of the crucible, or may constitute a separate material affixed into the crucible.

The crucible is constructed for receiving and holding molten metal therein. It will be appreciated that appropriate materials must be utilized for the crucible to withstand the molten metal conditions, and where the crucible is not a monolithic structure, the joints and seams between separate pieces of the crucible must be assembled to prevent molten metal leakage during sustained operation.

Figure 7:
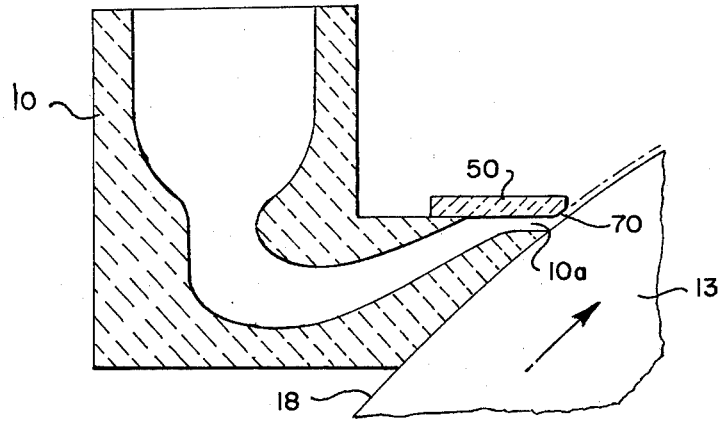
FIG. 7 is a cross-sectional view of a preferred crucible and nozzle of the present invention.

One preferred crucible 10 for continuous production of rapidly cast strip material is illustrated in detail in FIG. 7. It should be understood that the molten metal holding portion of the crucible 10, which is formed between the inside surfaces, may take a variety of forms or shapes. However, in a preferred embodiment an upper portion of the crucible 10 has a significantly larger cross-sectional volume than that of the nozzle area of the crucible 10 in order that the molten metal head height, above the nozzle 10*a*, is substantially unaffected by minor variations in molten metal volume in the crucible 10. Such structure contributes to the maintenance of a substantially constant metallostatic head pressure at the nozzle, even with minor variations in metal volume that may occur in the crucible 10 in sustained or continuous casting operations. It should be appreciated that casting may also be effected under externally applied pressure equipment which could be directly controlled.

As shown in FIG. 7, it is also preferable that the inside surfaces of the crucible 10 converge toward one another in the direction of the nozzle 10*a*, and that such inside surfaces be radiused, rounded or generally curvilinear at locations of turns or bends in the crucible 10 to minimize metal turbulence therein during a casting operation.

The molten metal holding area, formed between the inside surfaces of the crucible 10 shown in FIG. 7 should be enclosed, such as with sidewalls. It is noted that the width of the crucible nozzles of the present invention should not be limited. It has been found that a crucible 10 and nozzle 10*a* of the present invention may be constructed by first cutting or carving refractory boards, such as insulating boards made from fiberized kaolin, into the desired shape, such as that shown in FIG. 7. Any number of these boards 42 may be stacked upon one another to obtain the desired crucible 10 and nozzle 10*a* width. There is not expected to be a restriction on the maximum width of the crucible and nozzle of the present invention, and widths in excess of thirty six inches for strip portions from one crucible are comprehended by the present invention. After the requisite number of boards are stacked, the inside surfaces may be sanded or otherwise finished to provide generally smooth inside surfaces across the width of the stacked elements forming the crucible 10. It should also be understood that single piece materials may be used to construct a monolithic crucible in which case stacking would not be necessary. After the carved boards are stacked, the stack may be disposed between uncarved boards, which may serve as the sidewalls for the crucible 10.

To hold the stacked boards, including the sidewalls in position, it has been found convenient to dispose a metal plate against the outside surface of each sidewall and to bolt the plates together at a suitable number of locations about the crucible, thereby tightly compacting the crucible assembly. With such assembly, a minor amount of molten metal may tend to flow into the seams between the boards, but the compaction of the assembly causes the metal to freeze, and thereby arrest the flow before it adversely affects the crucible or the strip casting operation. It should be understood that the crucible of the present invention may be assembled with refractory cements, or the like, or may be constructed of a monolothic structure which does not require assembly.

As discussed above, a nozzle is located in each crucible, preferably in a lower portion thereof. The nozzle comprises an orifice passage defined between inside surfaces of the crucible. In a preferred embodiment as illustrated in FIG. 7, the nozzle 10*a* is formed between a crucible surface and an inside surface of an insert 50. A portion of the inside surface of the insert 50, is preferably disposed against a portion of a ridge formed by an outside surface of the crucible 10. The structure of such preferred crucible is more fully described in copending patent application Ser. No. 148,440, entitled Apparatus For Strip Casting, filed on May 9, 1980.

It should be appreciated that the insert 50, described in a preferred crucible of the present invention, may be easily replaced, although it is preferred that the inserts 50 and the crucible be reused, either together or separately. It should also be noted that damage to an insert 50 shall not render the entire crucible unserviceable. In the event of such insert damage, the insert 50 is merely replaced and the process may continue.

In a preferred embodiment, as shown in cross-section in FIG. 7, the insert 50 is provided with a front edge surface 70. In such embodiment, the front edge surface 70 faces the casting surface 18 and is disposed to within less than 0.120 inch of the casting surface 18. Preferably, the front edge surface 70 is disposed to within 0.080 inch and in a more preferred embodiment, to within 0.020 inch of the casting surface 18. It is also preferred that in such embodiment the front edge surface 70 be in substantially complete parallelism with the casting surface 18 movable therebelow.

When utilizing a drum or wheel, and a refractory insert 50, such complete parallelism may be accomplished by placing a sheet of sandpaper, or the like, against the casting surface 18 with the grit side of the sandpaper facing the insert 50. By moving the insert 50 into tight contact with the casting surface 18, with the sandpaper disposed therebetween, and by moving the casting surface and sandpaper simultaneously past the insert 50, the front edge surface 70 is ground by the grit side of the sandpaper into substantially complete parallelism with the casting surface 18. Such substantially complete parallelism may be achieved even when round or other curvilinear casting surfaces are employed. To achieve such parallelism by this procedure 400 or 600 grit sandpaper has been found to be adequate. Other surfaces of the crucible may be brought into substantially complete parallelism therewith by this same procedure.

By maintaining the front edge surface 70 in substantially complete parallelism with the casting surface 18, the standoff distance, or gap, between the front edge surface 70 and the casting surface 18 is maintained throughout the length thereof. It has been found that the gap between the front edge surface 70 and the casting surface 18 should be maintained at less than about 0.120 inch in order to successfully cast strip material. Preferably, this gap is maintained at less than about 0.080 inch and for casting certain alloys into thin gage strip, gaps less than 0.020 inch are preferred. Alternatively, the corner of the insert 50 may come to a point at the front edge 70 at a 90° junction of the front edge of the insert 50, as opposed to a defined surface length as discussed above.

What is preferred with respect to the bottom surface of the nozzle 10*a* is that such surface be disposed as close as possible to the casting surface 18, without causing any interference for the moveable casting surface therebelow. Accordingly, the such surface of the nozzle may just clear the casting surface 18, i.e., perhaps within about 0.002 inch. Such spacing must not be large enough to allow significant molten metal backflow therebetween during casting. It should be understood that provisions may have to be made for edge portions of strip material which may have to pass under a portion of another downstream crucible.

The crucibles 10 or 11 are preferably constructed of a material having a superior insulating ability. If the insulating ability is not sufficient to retain the molten material at a relatively constant temperture, auxiliary heaters such as induction coils 12 may have to be provided in and/or around the crucibles 10 and/or 11, or resistance elements such as wires may be provided. A convenient material for the crucibles is an insulating board made from fiberized koalin, a naturally occurring, high purity, alumina-silica fire clay. Such insulating material is available under the trademark Kaowool HS board. However, for sustained operations, and for casting higher melting temperature alloys, various other materials may have to be employed for constructing the crucible or the nozzle of the crucible including silica, alumina, graphite, alumina graphite, clay graphite, fire clay, quartz, boron nitride, silicon nitride, boron carbide, silicon carbide, zirconia, stabilized zirconia silicate, magnesia, chrome-magnesite and various combinations or mixtures of such materials.

Although other materials are comprehended by the present invention, the insert 50 forming part of the nozzle of the crucible is preferably constructed of boron nitride, silicon nitride, silicon carbide, boron carbide, zirconia or quartz.

It is imperative that the orifice passage of the nozzle 10*a* or 11*a* remain open and its configuration remain substantially stable throughout a strip casting operation. It is understandable that the nozzles should not erode or clog, significantly, during a multiplex strip casting sequence or certain objectives such as maintaining uniformity in the casting operation and of minimizing metal flow turbulence in the crucibles may be defeated. Along these lines, it appears that certain insulating materials may not be able to maintain their dimensional stability over long casting periods. To obviate this problem the nozzle 10*a* or 11*a*, especially that portion defined by an insert 50, may be constructed of a material which is better able to maintain dimensional stability and integrity during exposure to high molten metal temperatures for prolonged time periods.

The drive system and housing for the drum, wheel or other casting surface 16 of the present invention should be rigidly constructed to permit drum rotation without structural instability which could cause the drum to slip or vibrate. In particular, care should be taken to avoid resonant frequences at the operating speeds for the drum. The casting surface 18 should be capable of moving at a surface speed of from about 200 linear surface feet per minute to more that about 10,000 linear surface feet per minute. When utilizing a drum having a circumference of about 8 feet, this rate calculates to a drum speed from about 25 rpm to about 1250 rpm. A three horsepower variable speed reversible, dynamically braked motor provides an adequate drive system for an integral copper casting drum 2 to 10 inches thick and about 8 feet in circumference. Power requirements may have to be modified depending upon the type and size of casting surface 18 employed. It should be appreciated that the casting surface 18 can be moved in a direction opposite to that illustrated in the drawing, and that the crucible may be disposed at any location about a circular casting wheel.

In one embodiment, the casting surface 18 on the wheel or drum of the apparatus of the present invention is smooth. It has been found that in certain applications, such as for producing amorphous strip portions, finishing the peripheral surface 18 of a casting wheel 13 with 400-grit paper and preferably with 600-grit paper may yield improved product uniformity.

Figure 3:
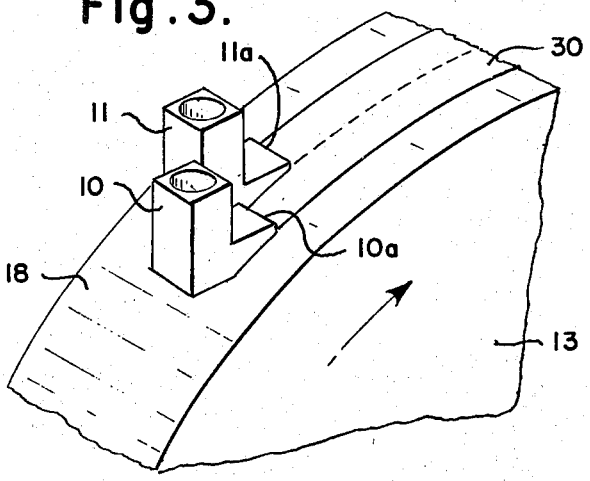
FIG. 3 is a partial perspective view illustrating an alternative apparatus of the present invention.

In an exemplary operation of the apparatus of the present invention, such as illustrated in FIGS. 1 or 3, molten metal is delivered to a first, heated crucible 10 and into a second crucible 11, although such metal delivery may be sequential rather than simultaneous. It is understood that a heater, such as induction coils of resistance wire 12, may be provided in and above the crucibles 10 and 11 to obtain or to maintain relatively constant molten metal temperatures as may be desired. In the operation of the apparatus of this invention metal may be poured directly into preheated crucibles. Such metal preheat temperature and the heating of the crucibles by auxiliary devices should prevent freezing or clogging of the nozzle during the initial casting operation, and the temperature of the flowing metal should thereafter keep the each crucible at sufficient temperature to insure uninterrupted molten metal flow through each nozzle. In certain applications, the nozzle should be externally heated throughout the casting operation. Also, the metal which is fed to the crucibles may be superheated to allow a certain degree of temperature loss without adversely affecting metal flow.

In one embodiment a metallostatic head height in the crucibles should be maintained at a relatively constant level throughout the casting operation to assure that a relatively constant static head pressure may be maintained at the nozzle. This may be accomplished by initially pouring the molten metal into each crucible to the desired height and thereafter controlling the rate at which additional molten metal is poured into that crucible to maintain the metallostatic head. It is understandable that the rate at which additional molten metal is fed to the crucible should be in substantial conformity with the rate at which metal flows from the nozzle onto the casting surface 18 in forming the multiplex strip material of the present invention. Maintenance of a relatively constant height of metal in the crucibles assures that the molten metal flow pressure through the respective nozzle is maintained relatively constant so as not to adversely affect the casting operation or the quality of the strip material. Alternatively, as mentioned above, externally applied pressure may be employed to control the pressure at the nozzles.

In the present invention, a rapidly quenched metallic strip 30 is cast onto the casting surface 18. Such strip material 30 comprises a plurality of dissimilar portions, such as portions a, b, c and d in FIG. 5 or portions $a_1$, b, and $a_2$ in FIG. 6. Each individual portion of the strip 30 is metallurgically alloy-bonded to the edges of adjacent portions along the longitudinal extent of the strip. Further, such metallurgical alloy-bonding occurs as an integral part of the strip casting operation.

Strip 30 having a plurality of dissimilar portions is called "multiplex strip" or "composite strip" in this application. The multiplex strip 30 of the present invention is intended to comprehend a strip having at least two dissimilar materials metallurgically alloy-bonded together along the longitudinal extent of the strip. This metallurgical alloy-bond occurs during the casting operation which forms the strip. The "at least two different materials" preferably refers to different compositions, however, such expression should also comprehend a multiplex strip which has the same composition but other properties which are different, including, but not limited to, electrical resistivity, permeability, conductivity, core loss characteristics, yield strength, hardness, atomic arrangement, gage, corrosion resistance, thermal expansion, color and the like.

For purposes of illustration, one portion of a multiplex strip of the present invention may have expansion characteristics different from that of a bonded, adjacent portion. Thus, by heating or cooling such strip, an intentional curvilinear strip material may be obtained. Also, the present invention may be employed to produce multiplex strip having amorphous strip portions metallurgically alloy-bonded to crystalline strip portions. When a strip of amorphous material is joined by conventional means, involving heating, such as welding, to a strip of crystalline material the amorphous strip becomes very brittle since the temperature to which it is exposed exceeds the crystallization temperature. By the present invention, however, the quench rate is so rapid that crystallization of the amorphous strip portion is substantially avoided, except possibly at the transition zone.

The rapid quenching of a strip operation may also be beneficial in the production of certain crystalline strip materials. Fast quenched crystalline alloys, in general, typically develop a highly desirable microstructure which is finer than conventionally produced crystalline materials. Also, rapidly cast crystalline materials may contain desirable alloy phases not found in conventional crystalline materials, and, conversely, rapid casting may avoid or inhibit the formation of adverse alloy phases. Additionally, rapid casting can produce new alloy phases in crystalline materials which although are metastable, typically exhibit improved properties.

In one preferred emobodiment, the present invention pertains to the manufacturing of multiplex strip 30 having an amorphous alloy portion which is formed with an adjacent metal or metal alloy portion, which may or may not be amorphous, the latter portion being integral with the first mentioned amorphous alloy portion. In the present invention the multiple strip portions may be cast simultaneously adjacent one another onto the casting surface 18, as shown in the embodiment illustrated in FIGS. 1 and 2. In this embodiment, the multiple nozzles 10*a* and 11*a* each deposit a stream of molten metal 20 and 22, respectively, onto approximately the same transverse line across the casting surface 18, adjacent to one another. As best shown in FIG. 2 the molten streams of metal converge to join one another and an actual alloying of the two converging streams actually occurs at the interface, also called the transition zone. It will be appreciated that the quench rate is so rapid in the casting of metallic strip material, that the merging streams do not experience sufficient residence time to significantly adversely affect the integrity of either metallic stream outside of the transition zone. Therefore, the composition, gage, hardness, strength, ductility, corrosion resistance and other properties of one portion of the strip are not adversely affected by the contact between adjacent portions even in their molten state.

Figure 4:
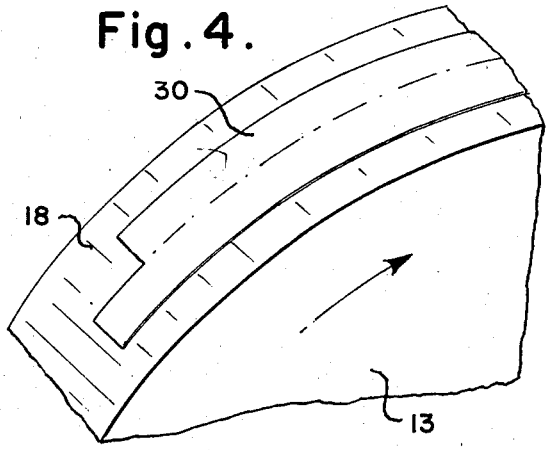
FIG. 4 is perspective view of the casting surface and the strip cast thereon from the apparatus shown in FIG. 3.

Alternatively, the multiple strip portion may be cast successively onto the casting surface 18 as shown in the embodiments illustrated in FIGS. 3 and 4. In such embodiment, a stream of molten metal is fed from one crucible 10 onto the casting surface 18. A second crucible 11 is located downstream of the first crucible 10 with respect to the casting direction illustrated by the arrow in FIG. 3. The second crucible 11 has a nozzle 11*a* which must be disposed such that a peripheral edge portion of the second stream of metal contacts a peripheral edge portion of the first metal to create a metallurgical alloy-bond therebetween during casting. It will be appreciated that the first stream may be molten, partially solidified or even totally solidified when the second stream contacts the peripheral edge. What is required by the edge-to-edge casting operation is that a metallurgical alloy-bond be created therebetween as the multiplex strip is formed.

Figure 5:
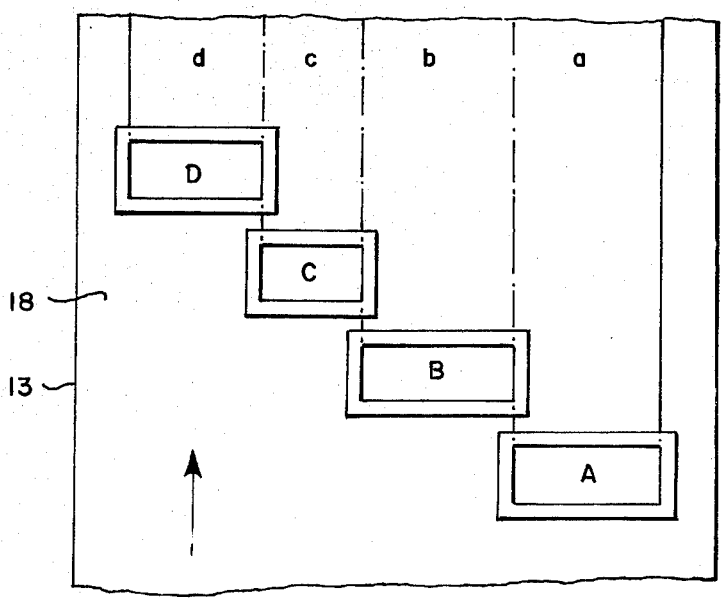
FIG. 5 is a top elevation view of an alternative apparatus of the present invention.

Although the development has been discussed with relation to two streams of metal to produce a duplex strip, it should be understood that any number of dissimilar portions may be metallurgically alloy-bonded together in the present invention. For example, FIG. 5 illustrates a multiplex, strip composed of four portions a, b, c and d cast from four separate crucibles A, B, C and D. Also, FIG. 6 illustrates a triplex strip which may be cast by disposing two streams of metal from two separate nozzles in a common crucible A adjacent both edge portions of a single strip portion, b, from tundish B to produce a multiplex strip having portion $a_1$, b and $a_2$ metallurgically alloy-bonded during casting. It will be appreciated that in this embodiment the two nozzles of crucible A are preferably separated by a bridge of approximately the same width as the central strip portion b.

In forming the metallurgical alloy-bond between adjacent dissimilar portions, such dissimilar strip portions are fused to one another. The joint between adjacent dissimilar portions, which is called the "transition zone" throughout this application, extends through the strip from its upper face to its lower face in a direction substantially parallel to the longitudinal axis of the strip. Although the transition zone is illustrated in chain lines in the drawings, it should be understood that such transition zone may not be readily discernable by ordinary observation.

One preferred embodiment of this invention may be directed to the production of razor blade stock. In such embodiment the composition of the metal in the first crucible 10 is preferably chosen to produce an amorphous alloy having properties of strength, hardness, ductility and corrosion resistance which properties are generally desirable for forming a razor blade cutting edge portion. The composition of the metal in the second crucible 11 may be chosen to provide a suitable backing material for the cutting edge portion of the strip.

EXAMPLE

A two-piece, or duplex, metal alloy strip was formed in accordance with the present invention using two crucibles, similar to that illustrated in FIG. 3. The casting surface comprised a 3.8 cm peripheral surface of a 20 cm diameter copper wheel rotated at a speed of 32 meters per second with the axis of rotation being substantially horizontal. In this example the crucible located slightly downstream with respect to the other crucible shall be referred to as the "first crucible". The first crucible 11 was made of silica and had a generally circular cross-section with an internal diameter of 10 mm tapering to a slit nozzle with internal dimensions of 5 mm by 0.42 mm. The bottom surface of the nozzle was maintained at about 0.43 mm above the casting surface, and the nozzle was disposed substantially parallel to the axis of the wheel. The first crucible 10 contained about 8.4 grams of an alloy composition $Fe_{83}Si_5B_{12}$, based on an atomic percent. This alloy is hereinafter called Alloy I.

The second crucible 10, also made of silica, was of circular cross-section with an internal diameter of 10 mm, tapering through 24 mm to a circular orifice having an internal diameter of about 0.64 mm. The bottom surface of the nozzle was maintained at about 0.43 mm above the casting surface. The second crucible 10 was displaced about 5 mm from the first crucible in a direction opposite to the rotation of the wheel. The second crucible 10, contained about 5.6 grams of an alloy composition $Fe_{40}$ $Ni_{40}$ $B_{20}$, based on atomic percent. The alloy is hereinafter called Alloy II.

One edge of the nozzle orifice of the second crucible 10 was disposed on the same circumferential line with respect to the wheel as one edge of the nozzle orifice of the first crucible, so that the two nozzle orifices would not, if transposed, substantially overlap.

In this example, both crucibles 10 and 11 lay in the general plane described by the wheel. As measured in a direction opposite to that of the rotation of the wheel, the first crucible 11 being 1.5° from the vertical and the second crucible 12 being 40° from the vertical. In this example, the crucibles were heated to about 1350° C. with an induction heating coil so as to melt their contents. The atmosphere in the crucibles was argon at atmospheric pressure, although protective atmospheres are not essential in this invention. The casting surface was moved past the nozzles at a peripheral speed of 32 linear meters per second and the crucibles were simultaneously over-pressured with argon to expel their contents, the first crucible 11 at 2 psi and the second crucible 10 at 7 psi. A continuous duplex strip was formed which was ejected from the casting surface in about one half of one second.

The strip was flat, having a width of about 4.5 mm. The strip portion originating from the first crucible 11 was about 2.7 mm wide and about 30 microns thick with the remaining portion approximately 50 microns thick. The ribbon was ductile and when caused to fail under test, showed no preferential parting at the joint, or transition zone. Both portions of the strip in this example were amorphous.

Figure 8:
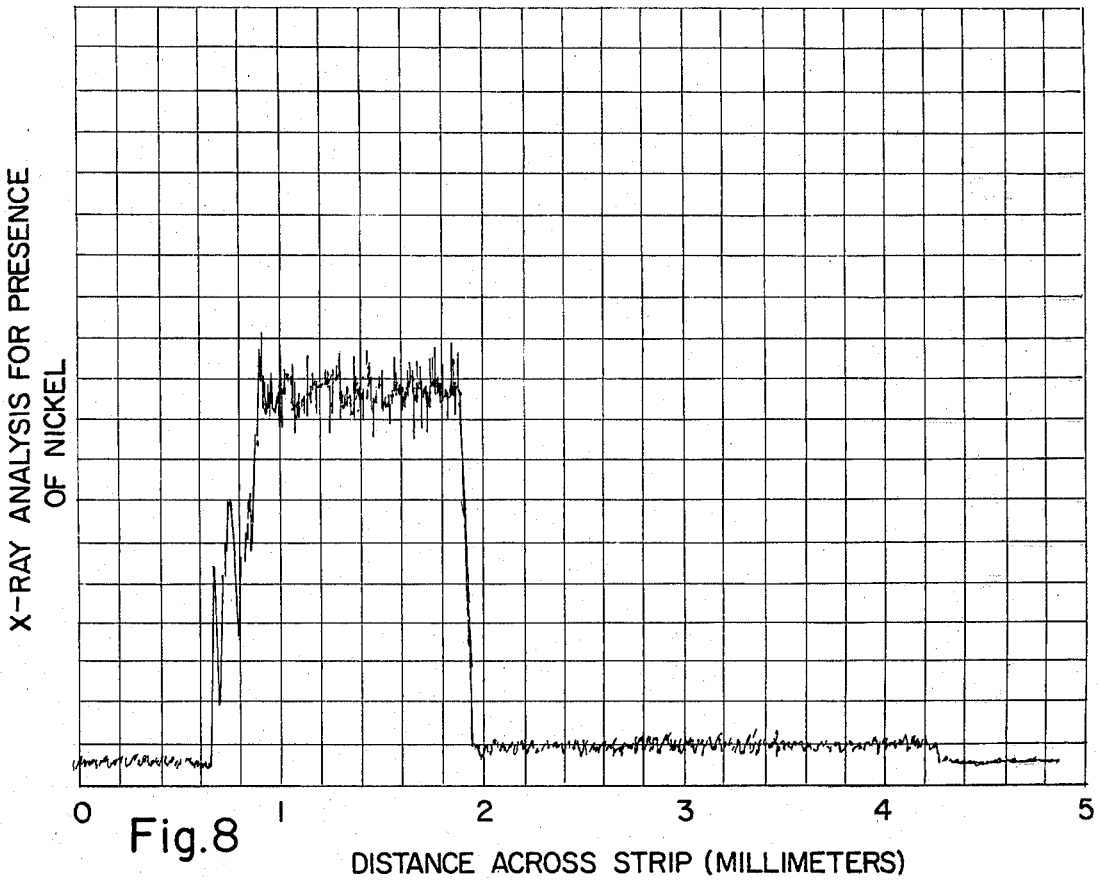
FIG. 8 is a graph of an energy dispersion X-ray analysis for the element nickel taken across the strip of the Example.
Figure 9:
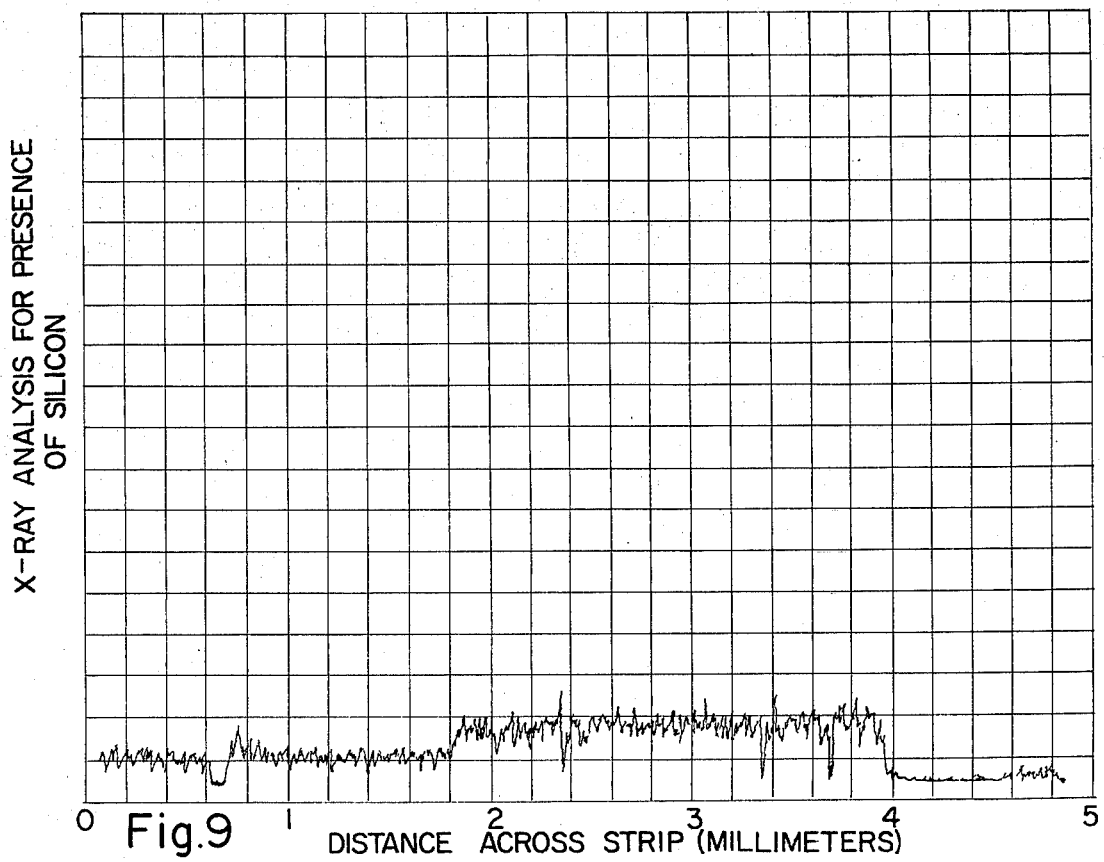
FIG. 9 is a graph of an energy dispersion X-ray analysis for the element silicon taken across the strip of the Example.

It has been found that beyond a very small distance from the joint between the two parts of the ribbon, on the order of less than 0.5 mm, the composition of one portion is not contaminated by metals from the other. Thus, analysing for nickel on the wheel face of the strip, a bold nickel peak was observed for 1.6 mm dropping to zero peak height over a distance of 0.05 mm at the junction. See the nickel trace illustrated in FIG. 8 wherein the height of the nickel trace is directly proportional to the amount of nickel in the Alloy II portion of the strip. Also, a scan for silicon had a sharp cutoff at the junction thereafter dropping to zero peak height. See the silicon trace illustrated in FIG. 9 wherein the height of the silicon trace is directly proportional to the amount of silicon in the Alloy I portion of the strip. The horizontal axis of the graphs of FIGS. 8 and 9 connotes distance, with the traced portion extending over a full distance of approximately four millimeters.

Figure 10:
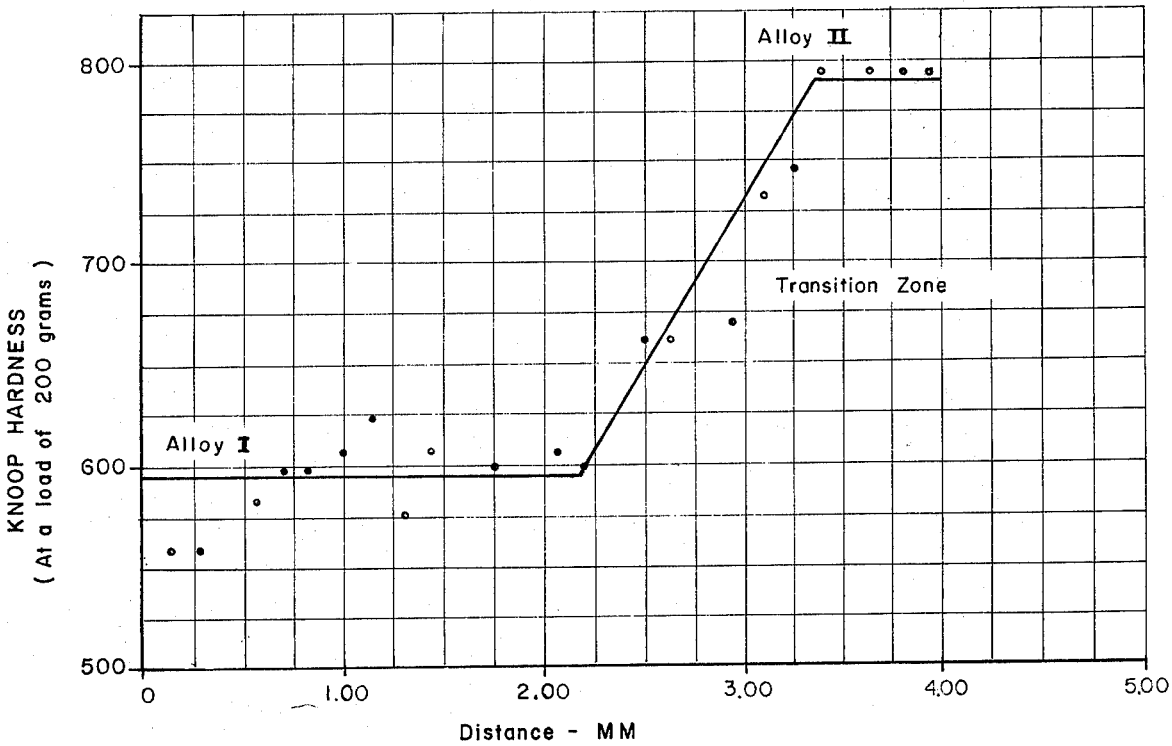
FIG. 10 is a graph of the Knoop hardness at a load of 200 grams taken across the strip of the Example.

The graph illustrated in FIG. 10 shows the Knoop hardness of this strip at a load of 200 grams. This graph illustrates that the transition zone, i.e. the extent of the joint where Alloy I and Alloy II strip portions are metallurgically alloy-bonded together, has a width of about 1.15 mm. As shown in FIG. 10, the strength of Alloy I and Alloy II, respectively, remains substantially uniform outside the transition zone. It is noted that although the strength of the strip at the transition zone usually has a value between the strengths of adjacent portions, with certain alloys, the metallurgical alloy-bond at the transition zone may exhibit a strength which is higher or lower than that of the adjacent portions, or the transition zone may consist of a separate alloy exhibiting other desirable properties including corrosive resistance, electrical resistivity, and the like. Thus, by appropriately choosing the dissimilar alloys, a combination alloy can be formed within the transition zone. Likewise, appropriate alloys may be chosen which could produce crystalline strip portions and an amorphous transition zone, or vice versa.

In general, the transition zone metallurgically alloy-bonding dissimilar strip portions has an identifiable width of less than about 1.50 mm or less than about five times the average gage of the bonded dissimilar portions. More preferably, the width of the transition zone is less than three times the average gage or thickness of the bonded portions.

While particular reference has been made to a duplex strip, it is also possible to produce multiplex strips having any number of dissimilar portions, by the present invention. For example, a multiplex strip can be produced which has a composition preferred for a cutting edge of a razor blade on both margins and an intermediate broad band of material appropriate for backing the cutting edge material. Such strip may then be formed into double edge razor blades or may be split longitudinally to provide single edge blades. In another example, the cutting edge composition of stainless steel may be used for a central portion of the strip, which is subsequently split longitudinally through the central portion to provide two strips of duplex form. A possible advantage of such triplex strip is the maintenance of its form when coiled for purposes of storage and subsequent processing.

During the continuous casting of multiple strip material, the tendency of the strip 30 to adhere to the casting surface 18 for a significant distance, such as several feet or more, beyond the nozzle has been observed. This phenomenon is beneficial in casting multiplex strip through staggered nozzles, such as shown in FIGS. 3, 5 and 6 however, it is understandable that if the strip material remains on a rotating casting drum or wheel 13 for a full revolution, damage to the crucibles could result. It has been found that the use of a doctor blade, such as a knife type element riding at or near the drum surface 18, approximately 2.5 to 6 feet from the nozzle may counter such adherence. With such an arrangement, the cast strip may be removed from the drum by such doctor blade. Such doctor blade has been found particularly useful in the production of thinner amorphous strip materials which appear to have a greater tendency to adhere to the casting surface 18 than do the crystalline strip materials. It is believed that the force which retains the strip on the casting surface reflects the quality of the thermal contact between the strip and the casting surface. Alternative arrangements, such as an air knife, may also be employed to separate the strip from the wheel.

The casting of relatively high quality multiplex strip material, possibly including amorphous strip portions, which for the purpose of this invention includes materials which are at least 50% amorphous, is feasible and practical using the apparatus and procedures described above. Understandably, the quency rates must usually be higher for amorphous material as compared to crystalline material. When necessary quench rates may be accelerated such as by increasing the speed of the casting surface, or the like.

Typical alloys which may be cast into multiplex strip in accordance with the present invention include those in which at least one portion comprises an alloy having iron, nickel, cobalt and combinations or mixtures thereof as a major constituent. Major constituents are those which dominate the composition such that no other element is present in a larger amount, based on atomic percentages. Such alloys typically contain, as minor constituents, silicon, boron, phosphorous, carbon, aluminum, vanadium, beryllium, chromium and combinations or mixtures thereof. Only incidental impurities, less than one percent, and preferrably less than 0.1%, should be present in such alloys. As mentioned above, such alloys are preferably amorphous, however crystalline alloys and combinations of crystalline and amorphous alloy portions are comprehended by the multiplex strip of the present invention. Preferred iron-base alloys for portions of the strip of this invention include the following:

$Fe_{80-85}\ Si_{3-7}\ B_{10-15}$
$Fe_{36-43}\ Ni_{36-43}\ B_{17-22}$
$Fe_{80}\ B_{12}\ Si_{8}$
$Fe_{79}\ B_{15}\ Si_{6}$
$Fe_{81}\ B_{13}\ C_{1}$
$Fe_{84}\ B_{15}\ Si_{1}$

Whereas the preferred embodiment has been described above for the purposes of illustration, it will be apparent to those skilled in the art that numerous variations of the details may be made without departing from the invention.

What is claimed is:

1. A rapidly quenched, thin cast metallic strip having an upper face and a lower face; said strip comprising a plurality of rapidly quenched, cast metallic dissimilar portions of at least two different compositions cast edge-to-edge, each portion having contacted a casting surface and metallurgically alloy-bonded during casting to an adjacent portions along the edges of said dissimilar portions of said strip; said strip having the metallurgical bond formed at a transition zone between portions having a width of less than five times the average thickness of the bonded portions and extending through the strip thickness from one face to the other face of the strip.

2. A strip as set forth in claim 1 wherein at least two adjacent portions of said strip have dissimilar atomic arrangement.

3. A strip as set forth in claim 2 wherein at least one dissimilar portion of said strip is amorphous.

4. A strip as set forth in claim 2 wherein at least one dissimilar portion of said strip is crystalline.

5. A strip as set forth in claim 1 wherein the metallurgical alloy-bond is formed at a transition zone which is amorphous and wherein the dissimilar portions adjacent said transition zone are crystalline.

6. A strip as set forth in claim 1 wherein adjacent dissimilar portions are amorphous and the metallurgical alloy-bond is formed at a transition zone therebetween which is crystalline.

7. A strip as set forth in claim 1 wherein at least one dissimilar portion of said strip is stainless steel.

8. A strip as set forth in claim 1 wherein at least two adjacent portions of said strip have dissimilar thicknesses.

9. A strip as set forth in claim 1 wherein at least two adjacent portions of said strip have dissimilar corrosion resistant properties.

10. A strip as set forth in claim 1 wherein at least two adjacent portions of said strip have dissimilar electrical properties.

11. A strip as set forth in claim 1 wherein at least two adjacent portions of said strip have dissimilar expansion characteristics.

12. A strip as set forth in claim 1 wherein at least one portion comprises an alloy having major constituents selected from the group consisting of iron, nickel and cobalt and mixtures thereof and minor constituents selected from the group consisting of silicon, boron, phosphorous, carbon, aluminum, vanadium, beryllium, chromium and mixtures thereof, with incidental impurities.

13. A strip as set forth in claim 1 wherein at least one portion is at least 50% amorphous and has a composition of $Fe_{80-85}\ Si_{3-7}\ B_{10-15}$, based on atomic percentages.

14. A strip as set forth in claim 1 wherein at least one portion is at least 50% amorphous and has a composition of $Fe_{36-43}\ Ni_{36-43}\ B_{17-22}$, based on atomic percentages.

15. A strip as set forth in claim 1 wherein at least one portion is at least 50% amorphous and has a composition of $Fe_{80}\ B_{12}\ Si_{8}$, based on atomic percentages.

16. A strip as set forth in claim 1 wherein at least one portion is at least 50% amorphous and has a composition of $Fe_{79}\ B_{15}\ Si_{6}$, based on atomic percentages.

17. A strip as set forth in claim 1 wherein at least one portion is at least 50% amorphous and has a composition of $Fe_{81}\ B_{13}\ Si_{5}\ C_{1}$, based on atomic percentages.

18. A strip as set forth in claim 1 wherein at least one portion is at least 50% amorphous and has a composition of $Fe_{84}\ B_{15}\ Si_{1}$, based on atomic percentages.

19. A strip as set forth in claim 1 wherein the metallurgical bond is formed at a transition zone between portions having a width of less than about 1.5 mm.

20. A strip as set forth in claim 1 wherein the metallurgical bond is formed at a transition zone having mechanical strength greater than that of both adjacent bonded portions.

21. A strip as set forth in claim 1 wherein the metallurgical alloy-bond is formed at a transition zone having lower mechanical strength than that of both adjacent bonded portions.

* * * * *